US011060170B2

(12) United States Patent
Kim et al.

(10) Patent No.: US 11,060,170 B2
(45) Date of Patent: Jul. 13, 2021

(54) NON-ORIENTED ELECTRICAL STEEL SHEET AND MANUFACTURING METHOD THEREFOR

(71) Applicant: POSCO, Pohang-si (KR)

(72) Inventors: Jae Hoon Kim, Pohang-si (KR); Hun Ju Lee, Pohang-si (KR); Yong Soo Kim, Pohang-si (KR); Su-Yong Shin, Pohang-si (KR)

(73) Assignee: POSCO, Pohang-si (KR)

( * ) Notice: Subject to any disclaimer, the term of this patent is extended or adjusted under 35 U.S.C. 154(b) by 66 days.

(21) Appl. No.: 16/469,878

(22) PCT Filed: Dec. 19, 2017

(86) PCT No.: PCT/KR2017/015023

§ 371 (c)(1),
(2) Date: Jun. 14, 2019

(87) PCT Pub. No.: WO2018/117598

PCT Pub. Date: Jun. 28, 2018

(65) Prior Publication Data

US 2020/0080175 A1 Mar. 12, 2020

(30) Foreign Application Priority Data

Dec. 19, 2016 (KR) ..... 10-2016-0173566

(51) Int. Cl.

| | |
|---|---|
| ***C22C 38/02*** | (2006.01) |
| ***C22C 38/06*** | (2006.01) |
| ***C22C 38/04*** | (2006.01) |
| ***C22C 38/00*** | (2006.01) |
| ***C21D 9/46*** | (2006.01) |
| ***C21D 8/02*** | (2006.01) |

(52) U.S. Cl.

CPC ..... *C22C 38/02* (2013.01); *C21D 8/021* (2013.01); *C21D 8/0226* (2013.01); *C21D 8/0236* (2013.01); *C21D 9/46* (2013.01); *C22C 38/004* (2013.01); *C22C 38/04* (2013.01); *C22C 38/06* (2013.01); *C21D 2201/05* (2013.01)

(58) Field of Classification Search

CPC .. C21D 2201/05; C21D 8/021; C21D 8/0226; C21D 8/0236; C21D 8/12; C21D 9/46; C22C 38/002; C22C 38/004; C22C 38/02; C22C 38/04

See application file for complete search history.

(56) References Cited

U.S. PATENT DOCUMENTS

| | | | | |
|---|---|---|---|---|
| 2009/0202383 | A1* | 8/2009 | Tanaka | C22C 38/06 420/83 |
| 2017/0241002 | A1* | 8/2017 | Nakajima | C22C 38/04 |

FOREIGN PATENT DOCUMENTS

| | | | | |
|---|---|---|---|---|
| JP | 04297557 | A | * 10/1992 | |
| JP | H04-297557 | A | 10/1992 | |
| JP | 05125495 | A | * 5/1993 | H01F 1/14775 |
| JP | H05-124495 | A | 5/1993 | |
| JP | H07-054044 | A | 2/1995 | |
| JP | 2581335 | B2 | 2/1997 | |
| JP | 2002-302746 | A | 10/2002 | |
| JP | 2005-120431 | A | 5/2005 | |
| JP | 2008-174773 | A | 7/2008 | |
| JP | 4380199 | B2 | 12/2009 | |
| JP | 2010-031328 | A | 2/2010 | |
| JP | 2010-121150 | A | 6/2010 | |
| JP | 2011-084761 | A | 4/2011 | |
| JP | 2011-246810 | A | 12/2011 | |
| JP | 5126788 | B2 | 1/2013 | |
| JP | 2014-0044929 | A | 4/2014 | |
| KR | 10-0418208 | B1 | 2/2004 | |
| KR | 10-0544584 | B1 | 1/2006 | |
| KR | 10-0544612 | B1 | 1/2006 | |
| KR | 10-0544417 | B1 | 4/2006 | |
| KR | 10-0733345 | B1 | 6/2007 | |
| KR | 10-0832342 | B1 | 5/2008 | |
| KR | 10-1037159 | B1 | 5/2011 | |
| KR | 10-1051747 | B1 | 7/2011 | |
| KR | 10-1059215 | B1 | 8/2011 | |
| KR | 10-1067478 | B1 | 9/2011 | |
| KR | 10-1089305 | B1 | 12/2011 | |
| KR | 10-1141278 | B1 | 5/2012 | |
| KR | 10-2016-0078183 | A | 7/2016 | |
| WO | 2016/027565 | A1 | 2/2016 | |

OTHER PUBLICATIONS

Extended European Search Report dated Oct. 23, 2019 issued in European Patent Application No. 17884042.7.

Y. He, et al., "Texture and magnetic properties of non-oriented electrical steels processed by an unconventional cold rolling scheme," Journal of Magnetism and Magnetic Materials, Amsterdam, NL, vol. 405, Dec. 18, 2015, pp. 337-352.

S. Steentjes, et al., "Effect of the Interdependence of Cold Rolling Strategies and Subsequent Punching on Magnetic Properties of NO Steel Sheets," IEEE Transactions on Magnetics, IEEE Service Center, New York, NY, vol. 52, No. 5, May 1, 2016, pp. 1-4.

(Continued)

*Primary Examiner* — Jenny R Wu

(74) *Attorney, Agent, or Firm* — Morgan, Lewis & Bockius LLP

(57) ABSTRACT

A non-oriented electrical steel sheet according to an embodiment of the present invention may include, by weight, by weight, 2.0 to 3.5% of Si, 0.3 to 2.5% of Al, 0.3 to 2.5% of Mn, individually or in a total amount of 0.0005 to 0.03% of at least one of Ga and Ge, and the remainder including Fe and impurities, and may satisfy the following Formula 1.

$$0.2 \leq ([Si]+[Al]+0.5\times[Mn])/(([Ga]+[Ge])\times 1000) \leq 5.27 \quad \text{[Formula 1]}$$

([Si], [Al], [Mn], [Ga] and [Ge] represent the content (% by weight) of Si, Al, Mn, Ga and Ge, respectively).

13 Claims, No Drawings

(56) References Cited

OTHER PUBLICATIONS

International Search Report and Written Opinion dated Apr. 3, 2018 issued in International Patent Application No. PCT/KR2017/015023 (with partial English translation).

Chinese Office Action dated Aug. 25, 2020 issued in Chinese Patent Application No. 201780078601.6.

Office Action issued in corresponding European Patent Application No. 17884042.7, dated Jan. 15, 2021.

* cited by examiner

NON-ORIENTED ELECTRICAL STEEL SHEET AND MANUFACTURING METHOD THEREFOR

CROSS-REFERENCE OF RELATED APPLICATIONS

This application is the U.S. National Phase under 35 U.S.C. § 371 of International Patent Application No. PCT/KR2017/015023, filed on Dec. 19, 2017, which in turn claims the benefit of Korean Application No. 10-2016-0173566, filed on Dec. 19, 2016, the entire disclosures of which applications are incorporated by reference herein.

TECHNICAL FIELD OF THE INVENTION

The present disclosure relates to a non-oriented electrical steel sheet and a method for manufacturing the same.

BACKGROUND OF THE INVENTION

Recently, as awareness of eco-friendly automobiles has been increased to reduce the generation of fine dust and greenhouse gas emissions, there has been a rapid increase in demand for non-oriented electrical steel sheets used for automobile driving motors. Unlike conventional internal combustion engine vehicles using engines, engines for environmentally friendly vehicles (hybrid, plug-in hybrid, electric, and fuel cell vehicles) are replaced by driving motors. In addition, various motors other than driving motors are required.

The driving range of eco-friendly vehicles is closely related to the efficiency of various motors including driving motors, and the efficiency of these motors is directly related to the magnetism of the electrical steel sheet. Therefore, in order to increase the driving range, it is necessary to use a non-oriented electrical steel sheet which is excellent in magnetic properties.

Since a driving motor of automobile must exhibit excellent characteristics in all areas ranging from low speed to high speed, unlike normal motors, it is necessary to output a large torque at a low speed or an acceleration, and decrese a loss at a constant speed or a high speed driving.

In order to obtain such characteristics, a non-oriented electrical steel sheet which is a motor iron core material must have a large magnetic flux density characteristic at a low speed rotation and a small high frequency iron loss at a high speed rotation.

Moreover, high mechanical strength is required because it must withstand the centrifugal force generated at a high speed rotation.

As a non-oriented electrical steel sheet for eco-friendly automobiles, a non-oriented electrical steel sheet containing a segregation element, such as Sn, Sb, and P, has been proposed. However, this is problematic in that brittleness is so strong that cold rolling is difficult. Accordingly, there has been proposed technique of lowering the content of Si and increasing the addition amount of Al and Mn to improve the cold rolling property or of lowering the content of Sn, Sb, and P used as a segregation element to further improve the cold rolling property. However, when concentrating on productivity such as cold rolling, magnetic properties are degraded and motor characteristics are deteriorated.

DETAILS OF THE INVENTION

Problems to be Solved

An embodiment of the present invention is to provide a non-oriented electrical steel sheet including a new additive element that can replace Sn, Sb, and P.

Another embodiment of the present invention is to provide a method for manufacturing a non-oriented electrical steel sheet.

Means to Solve the Problems

The non-oriented electrical steel sheet according to an embodiment of the present invention may include, by weight, 2.0 to 3.5% of Si, 0.3 to 2.5% of Al, 0.3 to 2.5% of Mn, individually or in a total amount of 0.0005 to 0.03% of at least one of Ga and Ge, and the remainder including Fe and unavoidable impurities, and may satisfy the following Formula 1.

$$0.2 \leq ([Si]+[Al]+0.5\times[Mn])/(([Ga]+[Ge])\times 1000) \leq 5.27 \quad \text{[Formula 1]}$$

([Si], [Al], [Mn], [Ga], and [Ge] represent the content (% by weight) of Si, Al, Mn, Ga, and Ge, respectively.)

The non-oriented electrical steel sheet according to one embodiment of the present invention may further include N: 0.0040% or less (excluding 0%), C: 0.0040% or less (excluding 0%), S: 0.0040% or less (excluding 0%), Ti: 0.0030% or less (excluding 0%), Nb: 0.0030% or less (excluding 0%), and V: 0.0040% or less (excluding 0%).

The non-oriented electrical steel sheet according to an embodiment of the present invention may include 0.0005 to 0.02% by weight of Ga and 0.0005 to 0.02% by weight of Ge.

The non-oriented electrical steel sheet according to one embodiment of the present invention may satisfy the following Formula 2.

$$3.3 \leq ([Si]+[Al]+0.5\times[Mn]) \leq 5.5 \quad \text{[Formula 2]}$$

([Si], [Al], and [Mn] represent the content (% by weight) of Si, Al, and Mn, respectively)

The non-oriented electrical steel sheet according to one embodiment of the present invention in which the strength ratio of the set tissue may satisfy P200/(P211+P310)≥0.5 when XRD test is performed on the area of ½t to ¼t of the thickness of the steel sheet. In this case, ½t means ½ of the thickness of the entire steel sheet, ¼t means ¼ of the thickness of the entire steel sheet. P200 means the surface strength of the set tissue in which the <200> plane lies parallel to the vertical direction of the steel sheet within 15 degrees, P211 means the surface strength of the set tissue in which the <211> plane lies parallel to the vertical direction of the steel sheet within 15 degrees, and P310 means the surface strength of the set tissue in which the <300> plane lies parallel to the the vertical direction of the steel sheet within 15 degrees, in XRD test.

The non-oriented electrical steel sheet according to an embodiment of the present invention may have an average diameter of grain is 50 to 95 μm The non-oriented electrical steel sheet according to one embodiment of the present invention may have a magnetic permeability at 100 A/m of 8000 or more and a coercive force at B=2.0T of 40 A/m or less.

The non-oriented electrical steel sheet according to an embodiment of the present invention may have a resistivity of 55 to 75 μΩ·cm.

A method of manufacturing a non-oriented electrical steel sheet according to an embodiment of the present invention may include: heating the slab including, by weight, 2.0 to 3.5% of Si, 0.3 to 2.5% of Al, 0.3 to 2.5% of Mn, individually or in a total amount of 0.0005 to 0.03% of at least one of Ga and Ge, and the remainder including Fe and unavoidable impurities, and satisfying the following Formula 1; hot rolling the slab to produce a hot-rolled sheet; cold rolling the hot-rolled sheet to produce a cold-rolled sheet; and finally annealing the cold-rolled sheet.

$$0.2 \leq ([Si]+[Al]+0.5\times[Mn])/(([Ga]+[Ge])\times 1000) \leq 5.27 \quad \text{[Formula 1]}$$

([Si], [Al], [Mn], [Ga] and [Ge] represent the content (% by weight) of Si, Al, Mn, Ga, and Ge, respectively.)

The slab may further include N: 0.0040% or less (excluding 0%), C: 0.0040% or less (excluding 0%), S: 0.0040% or less (excluding 0%), Ti: 0.0030% or less (excluding 0%), Nb: 0.0030% or less (excluding 0%), and V: 0.0040% or less (excluding 0%).

The slab may include 0.0005 to 0.02% by weight of Ga and 0.0005 to 0.02% by weight of Ge.

The slab may satisfy the following Formula 2.

$$3.3 \leq ([Si]+[Al]+0.5\times[Mn]) \leq 5.5 \quad \text{[Formula 2]}$$

([Si], [Al], and [Mn] represent the content (% by weight) of Si, Al, and Mn, respectively.)

Prior to the step of heating the slab, the method further include: producing a molten steel; adding Si alloy iron, Al alloy iron, and Mn alloy iron to the molten steel; and adding at least one of Ga and Ge to the molten steel and continuously casting the molten steel to produce a slab.

After the step of producing the hot-rolled sheet, the method further include the step of annealing the hot-rolled sheet.

Effects of the Invention

The non-oriented electrical steel sheet and manufacturing method according to an embodiment of the present invention are excellent in productivity as well as in magnetic properties.

DETAILED DESCRIPTIONS OF THE INVENTION

The terms "first," "second," "third" and the like are used to illustrate different parts, components, areas, layers and/or sections, but are not limited thereto. The terms are only used to differentiate a specific part, component, area, layer or section from another part, component, area, layer or section. Accordingly, a first part, component, area, layer or section, which will be mentioned hereinafter, may be referred to as a second part, component, area, layer or section without departing from the scope of the present disclosure.

The technical terms used herein are set forth to mention specific embodiments of the present disclosure and do not intend to define the scope of the present disclosure. The singular number used here includes the plural number as long as the meaning of the singular number is not distinctly opposite to that of the plural number. The term "comprises," used herein refers to the concretization of a specific characteristic, region, integer, step, operation, element and/or component, but does not exclude the presence or addition of other characteristic, region, integer, step, operation, element and/or component.

When it is said that any part is positioned "on" or "above" another part, it means the part is directly on the other part or above the other part with at least one intermediate part. In contrast, if any part is said to be positioned "directly on" another part, it means that there is no intermediate part between the two parts.

Unless otherwise specified, all the terms including technical terms and scientific terms used herein have the same meanings commonly understandable to those skilled in the art relating to the present disclosure. The terms defined in generally used dictionaries are additionally interpreted to have meanings corresponding to relating scientific literature and contents disclosed now, and are not interpreted either ideally or very formally unless defined otherwise.

Unless otherwise stated, % means % by weight, and 1 ppm is 0.0001% by weight.

In an embodiment of the present invention, the term "further includes an additional element" means an additional amount of the additional element substituted for the remainder of iron (Fe).

Hereinafter, embodiments of the present invention will be described in detail so that those skilled in the art can easily carry out the present invention. The present invention may, however, be embodied in many different forms and should not be construed as limited to the embodiments set forth herein.

In an embodiment of the present invention, in addition to optimizing the composition in the non-oriented electrical steel sheet, particularly the main additive components of Si, Al, and Mn, the addition amount of Ga and Ge, which are trace elements, is limited to remarkably improve the set tissue and the magnetism.

The non-oriented electrical steel sheet according to an embodiment of the present invention may include, by weight, 2.0 to 3.5% of Si, 0.3 to 2.5% of Al, 0.3 to 2.5% of Mn, individually or in a total amount of 0.0005 to 0.03% of at least one of Ga and Ge, and the remainder including Fe and unavoidable impurities.

First, the reason for limiting the components of the non-oriented electrical steel sheet will be described.

Si: 2.0 to 3.5 wt %

Silicon (Si) increses the resistivity of the material to lower the iron loss. If Si is added to little, the effect of improving the high frequency iron loss may be insufficient. On the contrary, when Si is added too much, the hardness of the material may increase and the cold rolling property may be extremely deteriorated.

Thus, the productivity and punching property may become poor. Therefore, Si can be added in the above-mentioned range.

Al: 0.3 to 2.5 wt %

Aluminum (Al) plays a role of lowering the iron loss by increasing the resistivity of the material. If Al is added too little, it may not be effective in the reduction of high frequency iron loss, and nitride is formed finely, which may deteriorate the magnetism. On the other hand, if Al is added too much, various problems may occur in all processes such as steelmaking and continuous casting, and thus the productivity may be greatly lowered. Therefore, Al can be added in the above-mentioned range.

Mn: 0.3 to 2.5 wt %

Manganese (Mn) enhances the resistivity of the material to improve the iron loss and form sulfide. When it is added too little, MnS may precipitate finely to deteriorate the magnetism. If it is added too much, the magnetic flux density may be reduced by promoting the formation of [111] set tissue, which may be disadvantageous to the magnetism. Therefore, Mn can be added in the above-mentioned range.

Ga and Ge: 0.0005 to 0.03 wt %

Gallium (Ga) and germanium (Ge) are segregated on the surface and grain boundaries of the steel sheet, thereby suppressing surface oxidation during annealing and improving the set tissue. In one embodiment of the present invention, at least one of Ga and Ge may be included. That is, Ga alone may be included, or Ge alone may be included, or Ga and Ge may be included at the same time. When Ge alone is included, 0.0005 to 0.03% by weight of Ge may be included. When Ga alone is included, 0.0005 to 0.03% by weight of Ga may be included. When Ga and Ge are included at the same time, the total amount of Ga and Ge may be 0.0005 to 0.03% by weight. If at least one of Ga and Ge is added too little, there is no such effect. If it is added too much, it is segregated in the grain boundaries to deteriorate the toughness of the material, thereby decreasing the productivity against magnetic improvement. Specifically, Ga and Ge may be included at the same time. Further, 0.0005 to 0.02% by weight of Ga and 0.0005 to 0.02% by weight of Ge may be included. More specifically, 0.0005 to 0.01% by weight of Ga and 0.0005 to 0.01% by weight of Ge may be conatined.

N: 0.0040% by weight or less

Nitrogen (N) not only forms fine and long AN precipitates inside the base material but also forms fine nitride by binding with other impurities to inhibit grain growth and deteriorate iron loss. Thus, it may be preferably limited to 0.0040 wt % or less, more specifically 0.0030 wt % or less.

C: 0.0040% by weight or less

Carbon (C) causes self-aging and binds with other impurity elements to generate carbide to degrade the magnetic properties. Thus, it may be preferably limited to 0.0040% by weight or less, more specifically 0.0030% by weight or less.

S: 0.0040% by weight or less

Sulfur (S) reacts with Mn to form a sulfide such as MnS to reduce grain growth and suppress the migration of the magnetic domain. Thus, it may be preferably limited to 0.0040 wt % or less. More specifically, it may be preferably limited to 0.0030 wt % or less.

Ti: 0.0030 wt % or less

Titanium (Ti) plays a role of suppressing grain growth and magnetic domain formation by forming carbide or nitride. Thus, it may be preferably limited to 0.0030 wt % or less, more specifically 0.0020 wt % or less.

Nb: 0.0030 wt % or less

Niobium (Nb) plays a role of suppressing the grain growth and the magnetic domain formation by forming carbide or nitride. Thus, it may be preferably limited to 0.0030 wt % or less, more specifically 0.0020 wt % or less.

V: 0.0030 wt % or less

Vanadium (V) plays a role of suppressing the grain growth and the magnetic domain formation by forming carbide or nitride. Thus, it may be preferably limited to 0.0030 wt % or less, more specifically 0.0020 wt % or less.

Other Impurities

Unavoidable impurities such as Mo, Mg, Cu and the like may be included in addition to the above-mentioned elements. Although these elements are included in trace amounts, they may cause deterioration of magnetism through the formation of inclusions in the steel. Therefore, it should be controlled as follows: Mo and Mg: not more than 0.005 wt %, respectively, and Cu: not more than 0.025 wt %.

The non-oriented electrical steel sheet according to one embodiment of the present invention satisfies the following Formula 1.

$$0.2 \leq ([Si]+[Al]+0.5\times[Mn])/(([Ga]+[Ge])\times 1000) \leq 5.27 \quad \text{[Formula 1]}$$

([Si], [Al], [Mn], [Ga] and [Ge] represent the content (% by weight) of Si, Al, Mn, Ga and Ge, respectively.)

When the value of the Formula 1 is less than 0.2, the effect of addition of Ga and Ge may be insignificant, and thus the magnetism may be deteriorated. When the value of the Formula 1 exceeds 5.27, a large amount of Ga and Ge are added. The set tissue may be deteriorated and the saturation magnetic flux density may decrease. Thus, the effect of improving high frequency magnetic properties may be lost.

The non-oriented electrical steel sheet according to one embodiment of the present invention can satisfy the following Formula 2.

$$3.3 \leq ([Si]+[Al]+0.5\times[Mn]) \leq 5.5 \quad \text{[Formula 2]}$$

([Si], [Al] and [Mn] represent the content (% by weight) of Si, Al and Mn, respectively.)

When the value of the above-described Formula 2 is satisfied, the cold rolling property can be ensured.

In one embodiment of the present invention, a certain amount of Ga and Ge may be added to improve the set tissue. More specifically, when the XRD test is performed on the area of ½t to ¼t of the steel sheet thickness, the strength ratio of the set tissue can satisfy P200/(P211+P310)≥0.5. In this case, ½t means ½ of the thickness of the entire steel sheet, ¼t means ¼ of the thickness of the entire steel sheet. P200 means the surface strength of the set tissue in which the <200> plane lies parallel to the vertical direction of the steel sheet within 15 degrees, P211 means the surface strength of the set tissue in which the <211> plane lies parallel to the vertical direction of the steel sheet within 15 degrees, and P310 means the surface strength of the set tissue in which the <300> plane lies parallel to the the vertical direction of the steel sheet within 15 degrees, in XRD test. The set tissue in which the <200> plane lies parallel to the vertical direction of the steel sheet within 15 degrees (i.e., ND//<200>) includes the axis of the easy magnetization. Thus, the larger the ratio is, the more favorable the magnetism is.

In addition, a set tissue in which the <211> plane lies parallel to the vertical direction of the steel sheet within 15 degrees (i.e., ND//<211>) and a set tissue in which the <310> plane lies parallel to the vertical direction of the steel sheet within 15 degrees (i.e., ND//<310>) are close to the axis of hard magnetization.

Thus, the smaller the ratio is, the more favorable the magnetism is. In the embodiment of the present invention, the magnetic improvement effect may be obtained in the low magnetic field region through the improved set tissue. Further, it may play a key role in improving the high frequency iron loss.

The non-oriented electrical steel sheet according to an embodiment of the present invention may have an average diameter of grains of 50 to 95 μm. The high-frequency iron loss is excellent in the above-mentioned range.

The non-oriented electrical steel sheet according to an embodiment of the present invention has improved magnetic permeability and coercive force and is suitable for high-speed rotation. As a result, when applied to motors of eco-friendly automobiles, it can contribute to improvement in mileage. Specifically, the non-oriented electrical steel sheet according to an embodiment of the present invention has a magnetic permeability at 100 A/m of 8000 or more and a coercive force at B=2.0T of 40 A/m or less.

The non-oriented electrical steel sheet according to an embodiment of the present invention may have a resistivity of 55 to 75 μΩ·cm. If the resistivity is too high, the magnetic flux density may be deteriorated and become unsuitable for a motor.

A method of manufacturing a non-oriented electrical steel sheet according to an embodiment of the present invention may include: heating the slab including, by weight, 2.0 to 3.5% of Si, 0.3 to 2.5% of Al, 0.3 to 2.5% of Mn, individually or in a total amount of 0.0005 to 0.03% of at least one of Ga and Ge, and the remainder including Fe and unavoidable impurities, and satisfying the following Formula 1; hot rolling the slab to produce a hot-rolled sheet; cold rolling the hot-rolled sheet to produce a cold-rolled sheet; and finally annealing the cold-rolled sheet.

First, the slab may be heated. The reason why the addition ratio of each composition in the slab is limited is the same as the reason for limiting the composition of the non-oriented electrical steel sheet described in the above, so repeated description is omitted. The composition of the slab is substantially the same as that of the non-oriented electrical steel sheet because the composition of the slab does not substantially change during the manufacturing process, such as hot rolling, hot-rolled sheet annealing, cold rolling, and final annealing, which will be described later.

The slab may be produced by the steps as follows: producing a molten steel; adding Si alloy iron, Al alloy iron, and Mn alloy iron to the molten steel; and adding at least one of Ga and Ge to the molten steel and continuously casting the molten steel. Si alloy iron, Al alloy iron, Mn alloy iron, Ga, Ge and the like can be adjusted so as to correspond to the composition range of the above-mentioned slab.

The slab is charged into a heating furnace and heated to 1100 to 1250° C. When heated at a temperature exceeding 1250° C., the precipitate may be redissolved and precipitated finely after hot rolling.

The heated slab is hot-rolled to 2 to 2.3 mm to produce a hot-rolled sheet. In the step of producing the hot-rolled sheet, the finishing temperature may be 800 to 1000° C.

After the step of producing the hot-rolled steel sheet, the step of annealing the hot-rolled steel sheet may be further included. At this time, the hot-rolled sheet annealing temperature may be 850 to 1150° C. If the annealing temperature of the hot-rolled sheet is less than 850° C., the tissue may not grow or grow finely. Thus, the synergistic effect of the magnetic flux density may be small. If the annealing temperature exceeds 1150° C., the magnetic properties may be rather deteriorated and the rolling workability may become poor due to the deformation of the plate shape. More specifically, the temperature range may be 950 to 1125° C. More specifically, the annealing temperature of the hot-rolled sheet is 900 to 1100° C.

The annealing of hot-rolled sheet may be performed in order to increase the orientation favorable to magnetism as required, and may be omitted.

Next, the hot-rolled sheet is pickled and cold-rolled to a predetermined thickness.

But the hot-rolled sheet can be cold-rolled to a final thickness of 0.2 to 0.65 mm by applying a reduction ratio of 70 to 95%, which may be differentiated according to the thickness of the hot-rolled sheet.

The final cold-rolled sheet may be subjected to final annealing so as to have an average dimater of grains of 50 to 95 μm. The final annealing temperature may be 750 to 1050° C. If the final annealing temperature is too low, recrystallization may not occur sufficiently. Further, if the final annealing temperature is too high, the rapid growth of grains may occur and the magnetic flux density and the high frequency iron loss may deteriorate. More specifically, the final annealing can be performed at a temperature of 900 to 1000° C. In the final annealing process, all the processed tissues formed in the previous cold rolling step can be recrystallized (i.e., 99% or more).

Hereinafter, the present invention will be described in more detail with reference to examples. However, these embodiments are only for illustrating the present invention, and the present invention is not limited thereto.

EXAMPLE 1

Slabs were prepared as shown in Table 1 below. The contents of C, S, N, Ti, Nb, V, and the like other than those shown in Table 1 were all controlled to 0.003% or less. The slab was heated to 1150° C. and hot-rolled at 850° C. to produce a hot-rolled sheet having a thickness of 2.0 mm. The hot-rolled sheet was annealed at 1100° C. for 4 minutes and pickled. Thereafter, the sheet was cold-rolled to a sheet thickness of 0.25 mm, and then subjected to final annealing at a temperature of 1000° C. for 38 seconds. The magnetic properties were determined by means of a single sheet tester in the rolling direction and in the vertical direction, and were shown in Table 2 below. The magnetic permeability is the magnetic permeability at 100 A/m and the coercive force is the coercive force at B=2.0T. For the set tissue, the steel sheet was cut to ½t and XRD (X-ray diffraction) test method was used to calculate the strength of each face.

TABLE 1

| Steel (wt %) | Si | Al | Mn | Ga | Ge | Ga + Ge | Formula 1 Value | Formula 2 Value | Note |
|---|---|---|---|---|---|---|---|---|---|
| 1 | 2 | 1 | 2 | 0.0015 | 0.0005 | 0.002 | 2 | 4 | Inventive |
| 2 | 2 | 2 | 2 | 0.0005 | 0.0005 | 0.001 | 5.0 | 5 | Inventive |
| 3 | 2 | 1 | 2.5 | 0.0245 | 0.0005 | 0.025 | 0.17 | 4.25 | Comparative |
| 4 | 2.5 | 0.7 | 2.5 | 0.002 | 0.003 | 0.005 | 0.89 | 4.45 | Inventive |
| 5 | 2.5 | 1 | 2 | 0.003 | 0.002 | 0.005 | 0.9 | 4.5 | Inventive |
| 6 | 2.5 | 0.5 | 1.4 | 0.0015 | 0.0035 | 0.005 | 0.74 | 3.7 | Inventive |
| 7 | 2.5 | 0.2 | 1 | 0.005 | 0.005 | 0.01 | 0.32 | 3.2 | Comparative |
| 8 | 2.8 | 0.5 | 1 | 0.004 | 0.004 | 0.008 | 0.475 | 3.8 | Inventive |
| 9 | 2.8 | 0.7 | 1.4 | 0.003 | 0.005 | 0.008 | 0.525 | 4.2 | Inventive |
| 10 | 2.8 | 1 | 2.4 | 0.005 | 0.003 | 0.008 | 0.625 | 5 | Inventive |
| 11 | 2.8 | 1 | 1.4 | 0.0002 | 0.0002 | 0.0004 | 11.25 | 4.5 | Comparative |
| 12 | 3 | 0.5 | 1 | 0.0095 | 0.0005 | 0.01 | 0.4 | 4 | Inventive |
| 13 | 3 | 0.7 | 1.4 | 0.0095 | 0.0005 | 0.01 | 0.44 | 4.4 | Inventive |
| 14 | 3 | 1 | 2.4 | 0.005 | 0.005 | 0.01 | 0.52 | 5.2 | Inventive |

TABLE 1-continued

| Steel (wt %) | Si | Al | Mn | Ga | Ge | Ga + Ge | Formula 1 Value | Formula 2 Value | Note |
|---|---|---|---|---|---|---|---|---|---|
| 15 | 3 | 2 | 1.4 | 0.003 | 0.007 | 0.01 | 0.57 | 5.7 | Comparative |
| 16 | 3.2 | 0.7 | 3 | 0.001 | 0.019 | 0.02 | 0.27 | 5.4 | Inventive |
| 17 | 3.2 | 0.3 | 2 | 0.0195 | 0.0005 | 0.02 | 0.225 | 4.5 | Inventive |
| 18 | 3.2 | 0.5 | 2 | 0.025 | 0.025 | 0.05 | 0.09 | 4.7 | Comparative |

TABLE 2

| Steel | Resis-tivity | P200/ (P211 + P310) | Magnetic Perme-ability | Coercive Force | Note |
|---|---|---|---|---|---|
| 1 | 58 | 0.6 | 8500 | 35 | Inventive |
| 2 | 70 | 0.65 | 8800 | 32 | Inventive |
| 3 | 61 | 0.45 | 7200 | 50 | Comparative |
| 4 | 64 | 0.58 | 9200 | 35 | Inventive |
| 5 | 64 | 0.55 | 9500 | 33 | Inventive |
| 6 | 55 | 0.68 | 8400 | 33 | Inventive |
| 7 | 49 | 0.42 | 6800 | 52 | Comparative |
| 8 | 56 | 0.57 | 8200 | 31 | Inventive |
| 9 | 61 | 0.63 | 8300 | 38 | Inventive |
| 10 | 70 | 0.52 | 8200 | 36 | Inventive |
| 11 | 64 | 0.38 | 7500 | 45 | Comparative |
| 12 | 58 | 0.56 | 8800 | 35 | Inventive |
| 13 | 63 | 0.55 | 8200 | 34 | Inventive |
| 14 | 72 | 0.61 | 8100 | 35 | Inventive |
| 15 | 78 | 0.37 | 7300 | 53 | Comparative |
| 16 | 74 | 0.6 | 8500 | 35 | Inventive |
| 17 | 64 | 0.53 | 8700 | 32 | Inventive |
| 18 | 66 | 0.31 | 6500 | 60 | Comparative |

As shown in Table 1 and Table 2, in the case of the inventive steels, the set tissue was improved and the magnetic permeability was large and the coercive force was small. On the other hand, in the case of the comparative steels in which the amount of addition of Ga and Ge was outside the range of the present invention, the set tissue was not improved, so that the magnetic permeability and the coercive force were weakened and the grain growth was poor.

It will be understood by those of ordinary skill in the art that various changes in form and details may be made therein without departing from the spirit and scope of the present invention as defined by the following claims and their equivalents. It will be understood that the invention may be practiced. It is therefore to be understood that the above-described embodiments are illustrative in all aspects and not restrictive.

What claimed is:

1. A non-oriented electrical steel sheet, comprising: by weight, 2.0 to 3.5% of Si, 0.3 to 2.5% of Al, 0.3 to 2.5% of Mn, individually or in a total amount of 0.0005 to 0.03% of at least one of Ga and Ge, and the remainder comprising Fe and unavoidable impurities, wherein the non-oriented electrical steel sheet satisfies the following Formula 1 and Formula 2:

$$0.2 \leq ([Si]+[Al]+0.5\times[Mn])/(([Ga]+[Ge])\times 1000) \leq 5.27 \quad \text{[Formula 1]}$$

$$3.3 \leq ([Si]+[Al]+0.5\times[Mn]) \leq 5.5 \quad \text{[Formula 2]}$$

wherein ([Si], [Al], [Mn], [Ga], and [Ge] represent the content, by weight %, of Si, Al, Mn, Ga, and Ge, respectively.

2. The non-oriented electrical steel sheet according to claim 1, further comprising N: 0.0040% or less, excluding 0%, C: 0.0040% or less excluding 0%, S: 0.0040% or less, excluding 0%, Ti: 0.0030% or less, excluding 0%, Nb: 0.0030% or less, excluding 0%, and V: 0.0040% or less, excluding 0%.

3. The non-oriented electrical steel sheet according to claim 1, comprising 0.0005 to 0.02% by weight of Ga and 0.0005 to 0.02% by weight of Ge.

4. The non-oriented electrical steel sheet according to claim 1, wherein the strength ratio of the set tissue satisfies P200/(P211+P310)≥0.5 when XRD test is performed on the area of ½t to ¼t of the thickness of the steel sheet wherein ½t means ½ of the thickness of the entire steel sheet, ¼t means ¼ of the thickness of the entire steel sheet, P200 means the surface strength of the set tissue in which the <200> plane lies parallel to the vertical direction of the steel sheet within 15 degrees, P211 means the surface strength of the set tissue in which the <211> plane lies parallel to the vertical direction of the steel sheet within 15 degrees, and P310 means the surface strength of the set tissue in which the <300> plane lies parallel to the vertical direction of the steel sheet within 15 degrees, in XRD test.

5. The non-oriented electrical steel sheet according to claim 1, wherein the average diameter of grain is 50 to 95 μm.

6. The non-oriented electrical steel sheet according to claim 1, having a magnetic permeability at 100 A/m of 8000 or more and a coercive force at B=2.0T of 40 A/m or less.

7. The non-oriented electrical steel sheet according to claim 1, having a resistivity of 55 to 75 μΩcm.

8. A method for manufacturing a non-oriented electrical steel sheet, comprising:

heating the slab comprising, by weight, 2.0 to 3.5% of Si, 0.3 to 2.5% of Al, 0.3 to 2.5% of Mn, individually or in a total amount of 0.0005 to 0.03% of at least one of Ga and Ge, and the remainder comprising Fe and unavoidable impurities, and satisfying the following Formula 1;

hot rolling the slab to produce a hot-rolled sheet;

cold rolling the hot-rolled sheet to produce a cold-rolled sheet; and finally annealing the cold-rolled steel sheet;

$$0.2 \leq ([Si]+[Al]+0.5\times[Mn])/(([Ga]+[Ge])\times 1000) \leq 5.27 \quad \text{[Formula 1]}$$

([Si], [Al], [Mn], [Ga], and [Ge] represent the content (% by weight) of Si, Al, Mn, Ga, and Ge, respectively).

9. The method for manufacturing a non-oriented electrical steel sheet according to claim 8, wherein the slab further comprises N: 0.0040% or less (excluding 0%), C: 0.0040% or less (excluding 0%), S: 0.0040% or less (excluding 0%), Ti: 0.0030% or less (excluding 0%), Nb: 0.0030% or less (excluding 0%), and V: 0.0040% or less (excluding 0%).

10. The method for manufacturing a non-orietned electrical steel sheet according to claim 8, wherein the slab comprises 0.0005 to 0.02% by weight of Ga and 0.0005 to 0.02% by weight of Ge.

11. The method for manufacturing a non-orietned electrical steel sheet according to claim 8, wherein the slab satisfies the following Formula:

$$3.3 \leq ([Si]+[Al]+0.5\times[Mn]) \leq 5.5 \quad \text{[Formula 2]}$$

([Si], [Al], and [Mn] represent the content, (% by weight of Si, Al, and Mn, respectively).

12. The method for manufacturing a non-oriented electrical steel sheet according to claim 8, prior to the step of heating the slab, further comprising: producing molten steel;

adding Si alloy iron, Al alloy iron, and Mn alloy iron to the molten steel; and adding at least one of Ga and Ge to the molten steel and continuously casting the molten steel to produce a slab.

13. The method for manufacturing a non-oriented electrical steel sheet according to claim 8, after the step of producing the hot-rolled sheet, further comprising the step of annealing the hot-rolled sheet.

* * * * *